United States Patent [19]

Sember

[11] 4,443,673

[45] Apr. 17, 1984

[54] VARIABLE ASPECT ARC CHUTE

[75] Inventor: James W. Sember, Scotia, N.Y.

[73] Assignee: General Electric Company, Schenectady, N.Y.

[21] Appl. No.: 330,429

[22] Filed: Dec. 14, 1981

[51] Int. Cl.[3] ..... H01H 33/04; H01H 33/12

[52] U.S. Cl. ..... 200/144 R; 200/146 R; 200/147 R

[58] Field of Search ..... 200/146 R, 144 R, 147 R

*Primary Examiner*—Robert S. Macon

*Attorney, Agent, or Firm*—Lawrence D. Cutter; James C. Davis, Jr.; Marvin Snyder

[57] ABSTRACT

A variable aspect arc chute comprises a stack of pivotally-mounted plates which are held in electrical contact along one edge thereof by means of a bias spring or other device. The arc chute may be employed in a circuit interrupter, connected in parallel arrangement across main contacts which the present invention protects from excessive arcing damage.

8 Claims, 4 Drawing Figures

VARIABLE ASPECT ARC CHUTE

BACKGROUND OF THE DISCLOSURE

The present invention relates to high current electrical interruption devices and, more particularly, to arc chutes employed in such devices.

Present-day equipment employed in power distribution systems is often required to interrupt large current flows. These devices, such as circuit breakers, must act repeatedly as opposed to fuse-type devices which act once to interrupt the current and then are discarded and replaced. Because of inherent inductive effects, the interruption of high current levels, often in excess of 1,000 amperes, generally results in an electric arc being struck between the separating portions of the main contact pair. The presence of this arc, through hot ionized plasma between the contacts, produces two undesirable results. First, the presence of the arc means that current flow is not instantaneously interrupted and this means that for a certain period of time following actuation of the drive mechanism which separates the contacts, there is a certain level of current flowing in the circuit which the circuit breaker is operating to protect. Second, the presence of the arc between the main contacts often results in erosion, pitting and general deterioration of the main contact surfaces. As a result, relatively high resistance regions on the contact surfaces can develop. Furthermore, if arcing is extensive, it is also possible under certain circumstances to heat the main contacts to a temperature sufficiently high so as to cause melting, and subsequent circuit breaker operation is impaired or inhibited. Accordingly, it is seen that mechanisms for minimizing the presence of electrical arcs between the main contacts are highly desirable.

One of the structures that is employed to assist in the removal of the arc struck between the main contacts is a device known as an arc chute. These devices have been employed in the past. These previously-employed arc chutes comprise stationary metal plates aligned substantially parallel to one another. In general, the arc between the main contacts is driven from the main contacts to the arc chute plates by magnetic forces or by gaseous forces. The arc then generally proceeds to travel in multiple arc paths (arclets) between the arc chute plates. However, decaying plasma between the main contacts may permit the arc to restrike across the main contacts and to move back out of the arc chute. Additionally, the number of arc chute plates between which the arc resides is also typically variable and difficult to predict for a particular arc chute design and even for multiple strikes with a single design.

The unpredictability of the number of arcs between the plates of the arc chute gives rise to a number of disadvantages for the conventionally-employed arc chute design. In particular, the voltage that the circuit interruption device is able to withstand subsequent to current interruption is proportional to the number of gaps in which arcing was occurring prior to total current cessation. Accordingly, it is seen that it is highly desirable that a sufficient number of gaps be provided together with the ability to ensure that arcing between each gap does, in fact, occur. Additionally, the ability of the circuit breaker to limit current is also proportional to the number of arcing gaps. Thus, the general, one would like to employ an arc chute having a large number of gaps. However, because of the limitation imposed by physical size, it is difficult to blow or otherwise transfer an arc between the main contacts and a high plate stack. The larger the number of gaps, the larger the number of plates which must be provided to form these gaps. Again, the larger the number of plates that are required, the higher the stack that is required. However, as was pointed out, transfer of the arc between the main contacts to such a long stack is impractical, if not impossible.

SUMMARY OF THE INVENTION

In accordance with a preferred embodiment of the present invention, an arc chute for use in electrical current interrupters comprises a stack of electrically conductive plates, each being mounted to pivot about a shaft lying substantially in the plane of the plates, with each of the shafts being substantially parallel. Additionally, the arc chute comprises bias means for holding the plates in electrical contact with one another along one of their edges and also means for separating these plates along their contacting edge. In accordance with one embodiment of the present invention, the stack of plates alternately comprises brass and steel material, to ensure that welding along the plate edges does not occur. Furthermore, there is disclosed herein an electric arc interrupter comprising the above-described variable aspect arc chute and further including a pair of main contacts electrically connected in parallel across the closed arc chute contacts together with means for substantially simultaneously separating the main contacts and the arc chute plates, the main contacts being opened somewhat before the arc chute plates. Such an arc interrupter also preferably includes a barrier between the main contacts and the arc chute comprising a material which evolves a gaseous material, such as hydrogen.

Accordingly, it is an object of the present invention to provide an arc chute which more reliably initiates and maintains a set of arcs therein.

It is also an object of the present invention to provide an arc interrupting device employing a variable aspect arc chute.

It is also an object of the present invention to provide a higher and more reliable voltage withstand following current zero conditions.

It is additionally an object of the present invention to provide an arc interrupting device exhibiting low main contact deterioration.

Lastly, it is an object of the present invention to provide an arc chute and arc interrupting device acting to prohibit restriking of the arc between the main contacts.

DESCRIPTION OF THE FIGURES

The subject matter which is regarded as the invention is particularly pointed out and distinctly claimed in the concluding portion of the specification. The invention, however, both as to organization and method of practice, together with further objects and advantages thereof, may best be understood by reference to the following description taken in connection with the accompanying drawings in which:

DETAILED DESCRIPTION OF THE INVENTION

Figure 1:
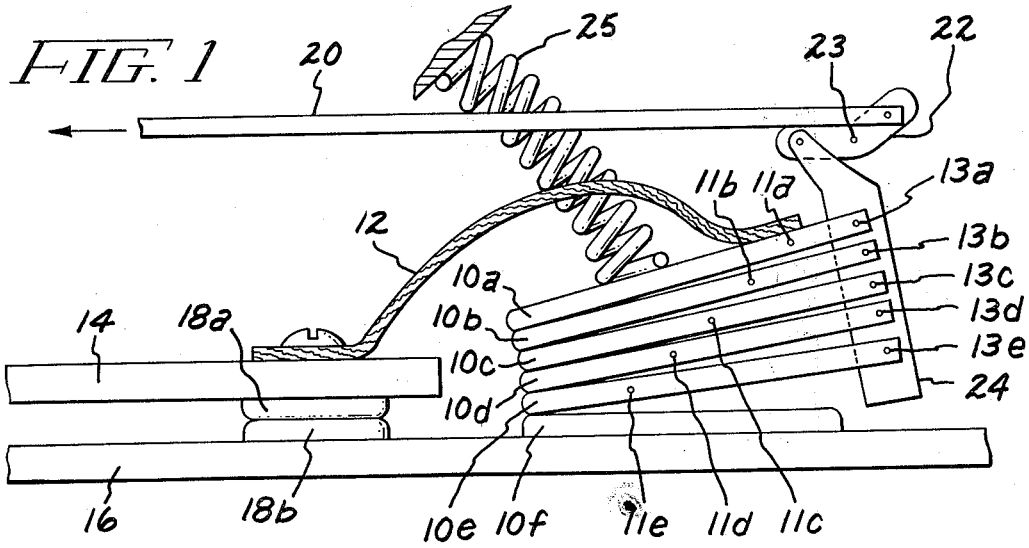
FIG. 1 is a side view illustrating the arc chute of the present invention together with main contacts, both shown, in a closed position.

FIG. 1 shows the variable aspect arc chute of the present invention in a closed position. The arc chute is configured as a stack of plates comprising an electrically conductive material. For example, plates 10*a* through 10*f* may comprise brass, steel, copper, or, less preferably, tinned plates comprising these materials. Plates 10*a* through 10*e* are pivotally mounted on shafts 11*a* through 11*e*. Plate 10*f* is a fixed plate and is electrically connected through conductive base member 16 to lower main contact 18*b*. Plates 10*a* through 10*f* are held in contacting relationship with one another through the force exerted by bias spring means 25. Spring 25 is positioned against any convenient fixed portion of the housing in which the interrupter is contained. Spring 25 is preferably positioned and angled such that, upon tripping of the device, it moves, or slips out of the way, so as not to impede the upward movement of the left-hand edges of the arc chute plates. Additionally, spring 25 is mounted so as to be readily returned to a compressed condition for holding the plate edges together upon actuation of a reset mechanism.

Plates 10*a*–10*e* are movable and pivotable about shafts 11*a* through 11*e*, respectively. These shafts are disposed through and substantially in the same plane as the plates. The ends of shafts 11*a*–11*e* may be disposed through any convenient aperture in the surrounding housing (not shown). The only particular requirement for the housing is that it comprise a nonconductive material and fit sufficiently snuggly about the ends of the shafts so as to prevent significant translation motion. Pivotal motion is provided either by the plates rotating about the shafts or by the shafts rotating within housing apertures provided for holding the shafts, or both. Alternatively, the plates may be cast, stamped or otherwise provided with side ears or lugs, instead of having shafts disposed through the plates. In this case, the lugs rotate within housing apertures.

In order to ensure proper formation of simultaneous series arclets between the plates, particularly along their contacting edges, it is preferable that the contacting edges of the plates be separated from one another through the motion of a single actuating lever 24. In order to ensure that this is the case, shafts 11*a*–11*e* must be positioned at appropriate distances from these contacting edges. These shafts are substantially parallel to one another, and preferably not coplanar. The actual position of these shafts is, however, preferably determined as described below.

Figure 2:
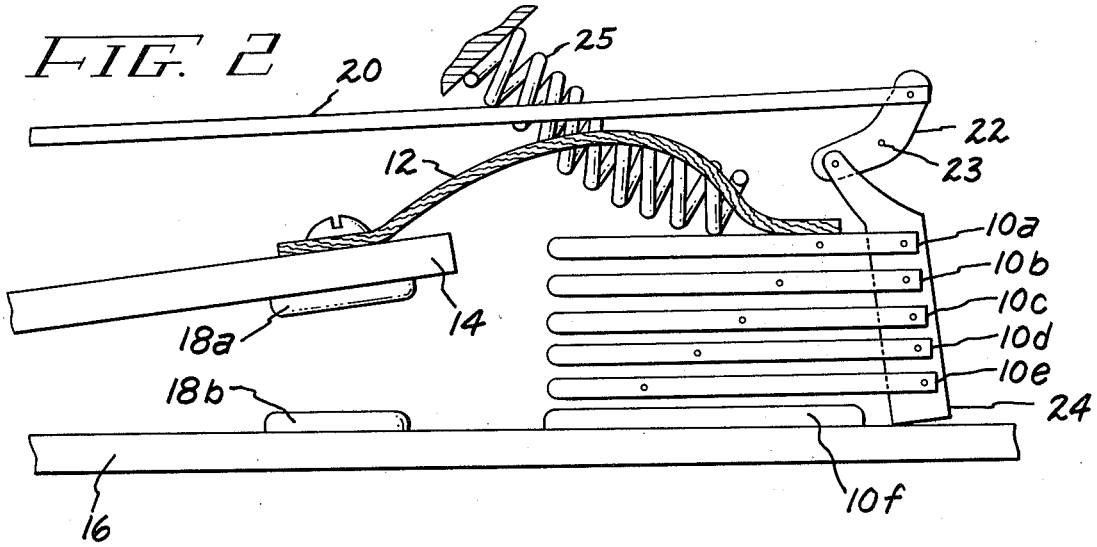
FIG. 2 is similar to FIG. 1 except that the interrupter is shown in an open position.
Figure 4:
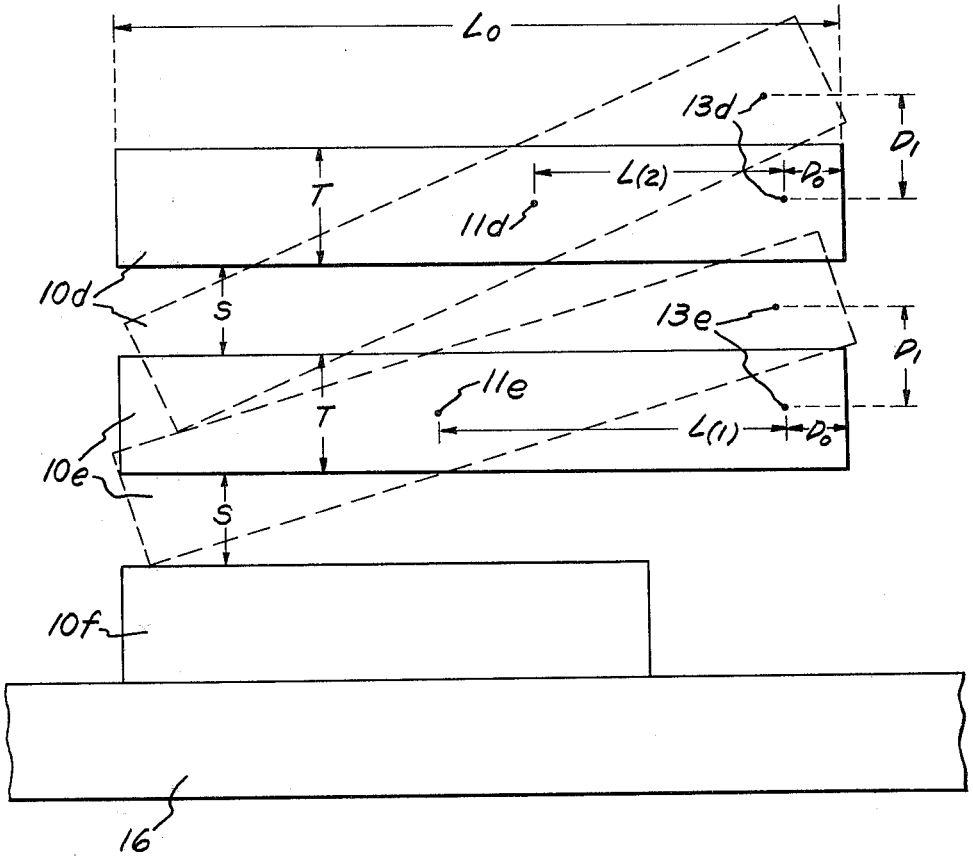
FIG. 4 illustrates the quantities and plate positioning for deriving equations (1) through (7).

To find the location of the pivot points 11*a* through 11*e* of plates 10*a* through 10*e* in FIG. 1, it may be assumed that the driven points 13*a* through 13*e* are all located a distance $D_o$ from the right-hand edge of each plate, and that they are all moved an equal vertical distance, $D_1$, when the plates 10*a* through 10*e* are opened to their parallel position, as shown in FIG. 2. FIG. 4 shows a detail of plates 10*d*, 10*e*, and 10*f* for the purpose of calculating the pivot point locations. As illustrated in FIG. 4:

L(N) is the distance between the driven point and the pivot point of the Nth plate;

$L_o$ is the total plate length;

T is the plate thickness; and

S is the distance between plates.

The distance between the pivot point and the driven point, L(n), can be determined by analytic geometry when all the other parameters have been chosen. For the first plate, $$L(1) = L_o - D_o + \frac{TL(1)}{2D_1\sqrt{1 - \frac{D_1^2}{L(1)^2}}} - \frac{(T + 2S)}{2D_1} L(1), \quad (1)$$

which has been solved easily by numerical methods for L(1). The location of the pivot points for all subsequent plates depends on the location of the pivot point of the previous plate. The equation for L(N) is very complex and will, therefore, be given in a number of steps. Let $$C = L_o - D_o, \quad (2)$$

$$M = \frac{D_1}{\sqrt{L(N-1)^2 - D_1^2}}, \quad (3)$$

and $$B = \frac{TL(N-1)}{2\sqrt{L(N-1)^2 - D_1^2}}. \quad (4)$$

Further, let $$Q = L(N-1) - L(N) - M(B - T - S), \quad (5)$$

then $$R = \frac{Q}{1 + M^2} - \sqrt{\frac{(C - L(N))^2 + \frac{T^2}{4} - (L(N-1) - L(N))^2 - (B - T - S)^2 + \frac{Q^2}{(1 + M^2)}}{(1 + M)^2}} \quad (6)$$

Finally, $$L(N) = L(N-1) - R - \sqrt{C^2 + \frac{T^2}{4} - (MR + B - T - S - D_1)^2} + \sqrt{L(N)^2 - D_1^2}. \quad (7)$$

When all of the appropriate expressions from the preceding equations are substituted into Equation (7), the only unknown is L(N). This equation can be solved for L(N) by interactive numerical methods for as many plates as are desired.

For a given set of plate thicknesses and gap thicknesses, this equation may be solved by well-known numerical methods to determine optimal positioning of shafts 11*a*–11*e* for promoting the simultaneous or near simultaneous opening of the arc chute plates. As an example illustrating one such method, a FORTRAN computer program that can be used to solve the above equations is listed at the end of this specification.

The arc chute plates also possess pivot points 13a–13e which are connected to actuating lever 24. Actuating lever 24 is connected to dog leg crank 22 which pivots about pivot point or shaft 23. Crank 22 is likewise pivotally connected to actuating arm 20 which acts in conjunction with conventional mechanical arrangements which serve to move contact arc 14 with upper main contact 18a in an upward direction. At almost the same time, and preferably shortly after main contact separation, a force is exerted, in the direction shown by the arrow in FIG. 1, on actuating arm 20 to turn crank arm 22 which pushes down on actuating lever 24 to separate the contacting edges of plates 10a–10f.

In the closed position shown in FIG. 1, the contacting edges of the arc plates form a current path which is in parallel with the current path formed through main contacts 18a and 18b. In particular, flexible conductive braid 12 connects top plate 10a to movable contact arm 14. This connection may, for example, be through the use of a screw as shown with respect to contact arm 14, or the braid may be soldered or welded to both plate 10a and contact arm 14 so as to form a reliable electrical connection. As contact arm 14 is opened, an arc of a limited nature develops between main contacts 18a and 18b. The arc develops because of the large currents generally employed in a device of the present kind and because of inherent parasitic inductive effects. However, the arc current is somewhat limited because of the presence of a relatively low resistive path through the arc chute plates which are initially in electrically-conducting contact with each other and with contact arm 14 through conductive braid 12. As the contact arm 14 continues in a direction away from conductive base member 16, the arc that was drawn between the main contacts 18a and 18b lengthens and increases in voltage. The increasing voltage causes still more of the arc current to be transferred to the arc plates which are still preferably in the closed position. In a relatively short period of time the arc across the main contacts becomes unstable and is extinguished, the plate stack now carrying the total current. Following this, preferably, actuating arm 20 operates to move the edges of the plates apart thereby causing a plurality of arclets to develop between the plates. The presence of these arclets is preferred since the voltage drop between braid 12 and base 16 is thereby increased. In the present invention there is a greater tendency for these arclets which develop to remain between the arc chute plates, since the arc across the main contacts was extinguished rapidly and the plasma permitted to decay. There is, therefore, a significantly decreased likelihood of a restrike across these main contacts. The variable arc chute design of the present invention ensures that the arc is distributed between all of the plates in a generally uniform fashion. This mode of operation produces the advantages of increased current limiting ability and higher recovery voltage following current zero conditions.

FIG. 2 is similar to FIG. 1 except that in FIG. 2 actuating arm 20 has been extended all the way to the left and crank 22 has impelled actuating lever 24 to its lowermost position, which in turn disposed plates 10a–10f in a substantially parallel configuration. Needless to say, actuating lever 24 preferably comprises a nonconductive material. The position shown in FIG. 2 is the final trip position of the device. However, it is to be noted that in the present invention, the arc or arclets generated between the arc chute plates is not an arc that has been transferred from between the main contacts. It is an arc that has been initiated within the arc chute itself upon separation of the contacting edges of the movable arc chute plates. It is these arc chute plates which bear the brunt of any deterioration caused by arcing current flowing between the plates. It is in this sacrificial manner that main contacts 18a and 18b are kept free of debris, deterioration and pitting. Furthermore, as the plates of the present invention separate along the contacting edge, there is observed a tendency for the arc or arclets formed to move to the right, away from any residual arc or hot plasma between the main contacts. However, most of the initial arcing occurs along the edges of the plates and, therefore, in certain particular high current situations, it is possible to form some metallic conductive melt along the plate edges, particularly during the early phase of arc chute plate opening. In order to ensure that welding of one plate to the other adjacent plates does not occur under these high current conditions, it is preferable that the arc chute stack of the present invention comprise plates of alternatingly different material which do not exhibit a tendency to weld together. As an example, steel and brass exhibit a noted lack of tendency to weld to one another. Nevertheless, such materials provide a sufficiently low resistance path under standby conditions during which the arc chute plate edges are in contact and carry a small amount of current. However, the bulk of the current is still maintained through main contacts 18a and 18b which generally exhibit a ten-fold lesser resistance than the chute plate stack.

Spring 25 is also shown in FIG. 2. In this implementation, it is noted that, upon plate opening, it slidably moves along the top of plate 10a to a position in which minimal downward force against the plate stack is exhibited.

Figure 3:
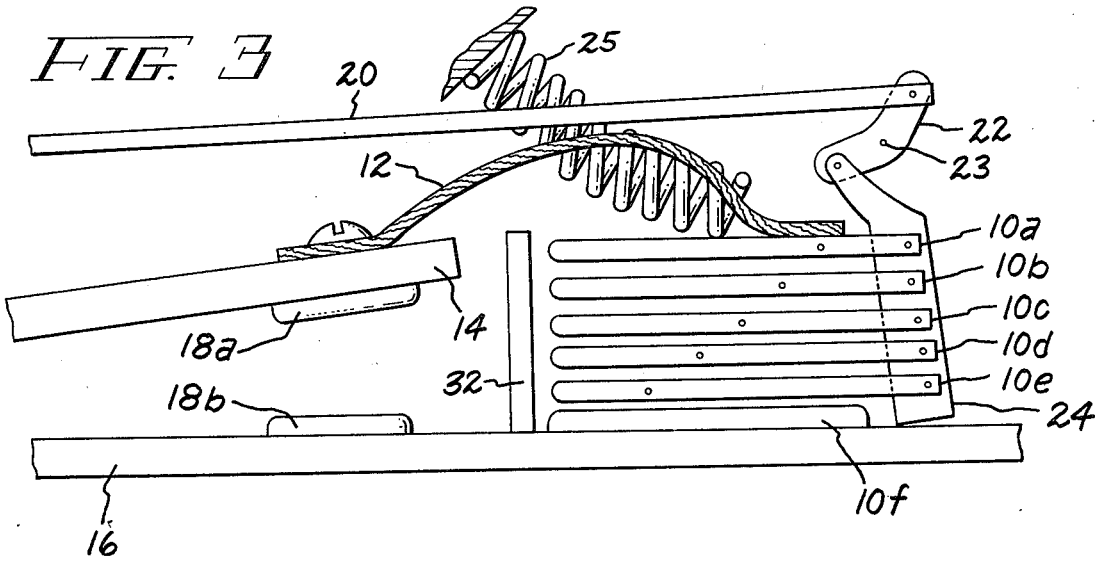
FIG. 3 is similar to FIG. 2 but further includes an insulating barrier for maintaining the arc or arcs within the arc chute.

FIG. 3 illustrates the same opened arc chute position as seen in FIG. 2 except that there is additionally shown an insulating barrier 32 which acts to prevent the plasma which is generated in the arc chute from moving out into the region between main contacts 18a and 18b. This barrier, therefore, reduces the possibility of arc restrike between the main contacts. Furthermore, barrier 32 preferably comprises a material which evolves a gaseous material such as hydrogen. A material used for this purpose is Delrin®. This material, and others serving a similar purpose, have a tendency to emit gaseous material that tends to increase the arc voltage by cooling of the arc column. Accordingly, it, too, assists in quickly extinguishing arcs existing between the main contacts. As pointed out above, it also serves to prevent transfer of arc to or from the region between the main contacts and the entrance to the arc chutes.

From the above it may be appreciated that the present invention provides a variable aspect arc chute exhibiting advantages heretofore not found in prior art arc chute devices. In particular, the present invention arc chute more reliably acts to extinguish main contact arcs. It also serves a function of providing increased current limiting capabilities to circuit interrupting devices along with the capability of exhibiting higher recovery voltages after zero current. The arc chute of the present invention is employable in conjunction with main contacts to prevent their erosion and deterioration and to more reliably prevent arcing between such contacts, particularly between contacts carrying large currents, such as those in excess of 1,000 amperes. Furthermore, the present invention provides the capability of stacking a much larger plurality of arc chute plates than has heretofore been possible. A significant reason for this is that the arc chutes of the present invention do not depend upon transfer of the arc by magnetic or gaseous movement means to a position between the arc chute plates. The arclets are actually initiated between the arc chute plates themselves as they are parted along one of their edges. This provides for a large number of arc gaps in series thereby exhibiting improved voltage performance characteristics. The actual number of arc plates used will depend on various design considerations such as voltage and current ratings and the desired extent of current limitation.

While the invention has been described in detail herein in accord with certain preferred embodiments thereof, many modifications and changes therein may be effected by those skilled in the art. Accordingly, it is intended by the appended claims to cover all such modifications and changes as fall within the true spirit and scope of the invention.

FORTRAN Computer Program for Equations Hereinabove

```
FTN4,B,L
      PROGRAM VACPT(3,90)
      REAL L(20),L0,M
      D0=.125
      D1=.25
      L0=1.5
      S=.125
      T=.125
      WRITE(1,1)
1     FORMAT(" ENTER TOTAL NUMBER OF PLATES (<=20):_")
      READ(1,*)N
      C=L0-D0
C
C*******************          FIND L(1)          *******************
C
C*******************        INITIAL GUESS        *******************
C
      XL=C-D0-.0001
C
100   L(1)=C+T*XL/2./D1/SQRT(1-(D1/XL)**2)-XL*(T+2.*S)/2./D1
          IF (ABS(L(1)-XL).LT.1.E-6) GO TO 200
C**********     IF L(1) NOT CLOSE ENOUGH TO XL, GUESS AGAIN     **********
C
          XL=.5*(L(1)+XL)
      GO TO 100
C
C*****************     FIND THE REST OF THE L(N)'S     *****************
C
200   DO 400 I=2,N
          M=D1/SQRT(L(I-1)**2-D1**2)
          B=T*L(I-1)/2./SQRT(L(I-1)**2-D1**2)
C*******************        INITIAL GUESS        *******************
C
          XL=L(I-1)
C
250       Q=L(I-1)-XL-M*(B-T-S)
            R=Q/(1+M**2)-SQRT(((C-XL)**2+T**2/4.
      &       -(L(I-1)-XL)**2-(B-T-S)**2+Q**2/(1+M**2))/(1+M**2))
           L(I)=L(I-1)-R-SQRT(C**2+T**2/4.-(M*R+B-T-S-D1)**2)
      &         +SQRT(XL**2-D1**2)
            IF (ABS(L(I)-XL).LT.1.E-6) GO TO 400
C*******************          NEW GUESS          *******************
C
            XL=XL-5.*(XL-L(I))
          GO TO 250
400   CONTINUE
C
C*******************        OUTPUT DATA          *******************
C
      WRITE(1,2)
2     FORMAT(" N  L(N) (INCHES)"/)
      DO 500 I=1,N
          WRITE(1,3)I,L(I)
3         FORMAT(3X,I3,3X,F10.3)
500   CONTINUE
999   END
      END$
```

The invention claimed is:

1. An arc chute for use in electrical current interrupters comprising:

a stack of plates comprising electrically conductive material, each plate being mounted to pivot about an axis lying substantially in the plane of said plate, each of said axes being substantially parallel to one another;

bias means for holding said plates in electrical contact with each other along an edge thereof; and means for separating said contacting plates.

2. The arc chute of claim 1 in which every other one of said plates comprises a second electrically conductive material exhibiting low weldability to adjacent plates.

3. The arc chute of claim 1 in which said plates alternately comprise brass and steel.

4. The arc chute of claim 1 in which each of said axes is selectively positioned with respect to the contacting edge of its respective plate so that pivotal movement of said plates about said axes, brought about through the motion of a linkage lever pivotally attached to said plates near plate edges opposite said contacting edges, provides substantially simultaneous separation of said plates along said contacting edges.

5. The arc chute of claim 1 further including a linkage lever pivotally attached to said plates near plate edges opposite said contacting edges.

6. An electrical arc interrupter comprising:

the arc chute of claim 1;

a pair of main contacts, one of said main contacts being electrically connected to the bottom plate of said stack, the other of said main contacts being electrically connected to the top plate of said stack; and means for substantially simultaneously separating said main contacts and said arc chute plates, said main contacts being opened somewhat prior to said arc chute plates.

7. The arc interrupter of claim 6 including a barrier disposed between said main contacts and said arc chute.

8. The arc interrupter of claim 7 in which said barrier comprises material which evolves a gaseous material.

* * * * *